United States Patent [19]

Davis

[11] 4,350,546

[45] Sep. 21, 1982

[54] METHOD OF MAKING A COVER FOR A LUGGAGE CASE

[75] Inventor: Michael Davis, New Castle, Pa.

[73] Assignee: Airway Industries, Inc., Ellwood City, Pa.

[21] Appl. No.: 289,697

[22] Filed: Aug. 3, 1981

Related U.S. Application Data

[60] Division of Ser. No. 111,205, Jan. 11, 1980, Pat. No. 4,307,765, which is a continuation of Ser. No. 820,597, Aug. 1, 1977, abandoned.

[51] Int. Cl.[3] ..... B32B 7/08

[52] U.S. Cl. ..... 156/93; 112/265.1; 112/405; 112/441; 150/1.6; 150/52 R; 190/53; 428/57; 428/77; 428/81; 428/102

[58] Field of Search ..... D3/76; 150/1.6, 52 R; 190/26, 41 R, 53; 428/14, 35, 45, 47, 54, 55, 58, 68, 76, 78, 57, 60, 77, 79, 81, 102, 189, 190; 112/405, 426, 441, 262.1, 265.1; 156/93

[56] References Cited

U.S. PATENT DOCUMENTS

| | | | |
|---|---|---|---|
| D. 112,729 | 12/1938 | Worthington | D3/76 |
| D. 159,128 | 6/1950 | Alpert | D87/5 |
| D. 252,235 | 6/1979 | Davis | D3/76 |
| 276,152 | 4/1883 | Barricklo . | |
| 948,165 | 1/1910 | Erstling . | |
| 958,860 | 5/1910 | Dresner . | |
| 1,119,517 | 12/1914 | Kaufmann . | |
| 1,871,197 | 8/1932 | Plotkin . | |
| 1,964,820 | 7/1934 | Kaufmann | 190/41 |
| 2,661,823 | 12/1953 | Goetz | 190/24 |
| 3,309,451 | 3/1967 | Holtzman | 264/258 |
| 3,582,441 | 6/1971 | Guffan | 428/77 |
| 3,921,768 | 11/1975 | Gorky | 190/26 |
| 4,042,433 | 8/1977 | Hardy et al. | 156/87 |

FOREIGN PATENT DOCUMENTS

| | | |
|---|---|---|
| 191613 | 7/1919 | Canada . |
| 266482 | 12/1926 | Canada . |
| 459035 | 8/1949 | Canada . |
| 574132 | 4/1959 | Canada . |

OTHER PUBLICATIONS

Luggage & Leather Goods, Jul. 1974—Cover, pp. 3, 22 and 23.

*Primary Examiner*—Edward C. Kimlin
*Assistant Examiner*—Robert A. Dawson
*Attorney, Agent, or Firm*—Buell, Blenko, Ziesenheim & Beck

[57] ABSTRACT

A cover for a luggage case, embodying decorative side panels of simulated multi-laminar construction. Portions of the periphery of the principal sheet of covering material are cut away and decorative strips fastened in overlying outwardly projecting relation to the cutaway portions to complete the outer contour of the principal sheet. The edge of a surrounding strip is attached, as by stitching, to the outer peripheral edge of the combined principal sheet and decorative strips. After securing the overlapping ends by stitching together, the surrounding strip is readily disposed at a right angle for attachment to the shell of the luggage case.

2 Claims, 7 Drawing Figures

METHOD OF MAKING A COVER FOR A LUGGAGE CASE

This application is a division of copending application Ser. No. 111,205 filed Jan. 11, 1980, now U.S. Pat. No. 4,307,765, which is in turn a continuation of application Ser. No. 820,597, filed Aug. 1, 1977, and now abandoned.

This invention relates to a cover for a luggage case, such as an attache case, in which the side panels simulate multi-laminar construction, but which, in fact, comprises only a single layer of sheet material constituting the side panel.

In my copending application Ser. No. 758,671, filed Jan. 12, 1977, now U.S. Pat. No. 252,235, I have disclosed a new design of side panel for a luggage case characterized by a decorative design having the edge wise appearance of a multi-laminar construction. This design of side panel is characterized by some degree of thickness which makes it difficult for the person doing the stitching of the laminations.

It is the purpose of my present invention to provide a cover for a luggage case which gives the appearance of the side panel design in the aforesaid copending application Ser. No. 758,671, but which is characterized by greater ease of workability due to the reduced number of the laminations making up the cover.

I accordingly provide a cover for a luggage case characterized by a novel construction and method of making.

Figure 1:
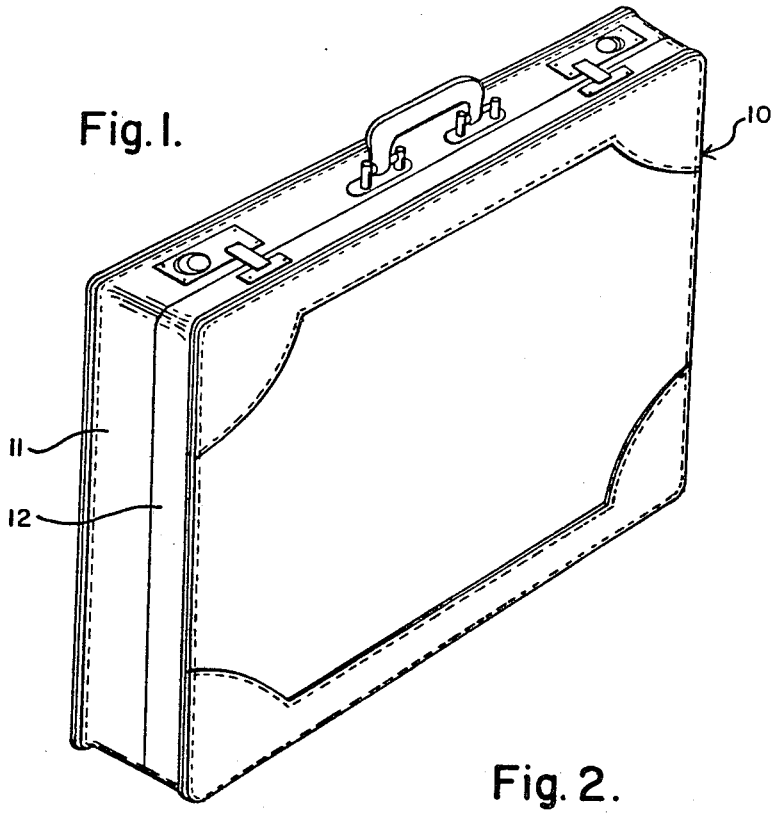
Figure 4:
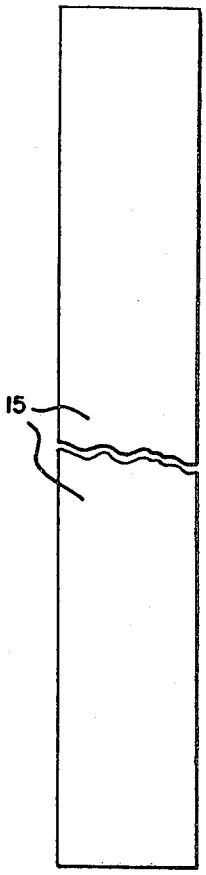
Figure 2:
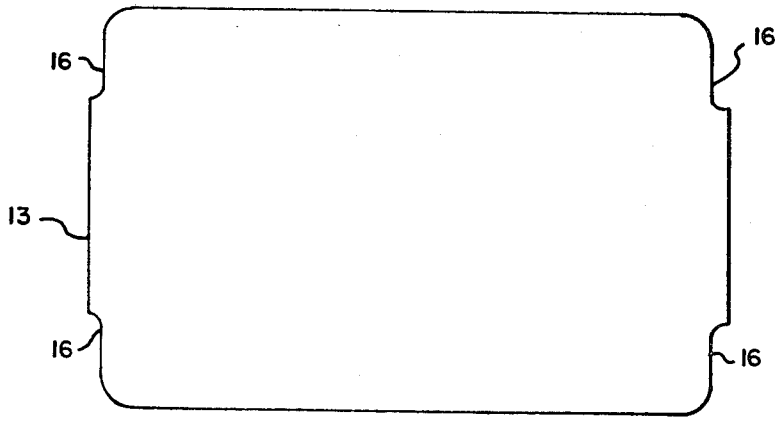
Figure 3:
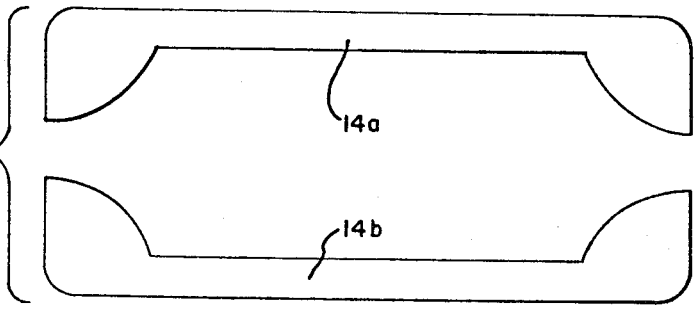
Figure 5:
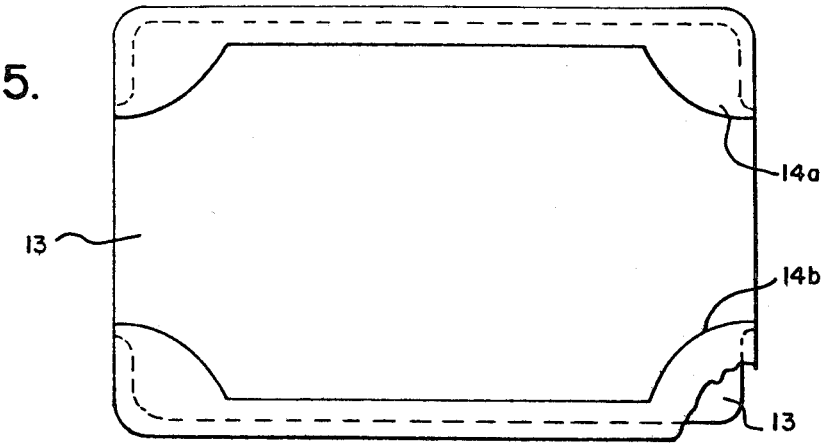
Figure 6:
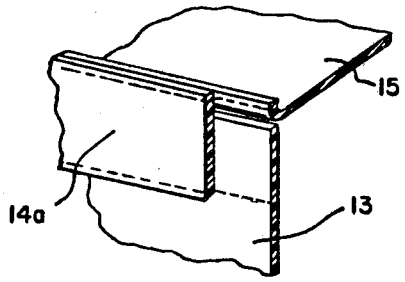
Figure 7:
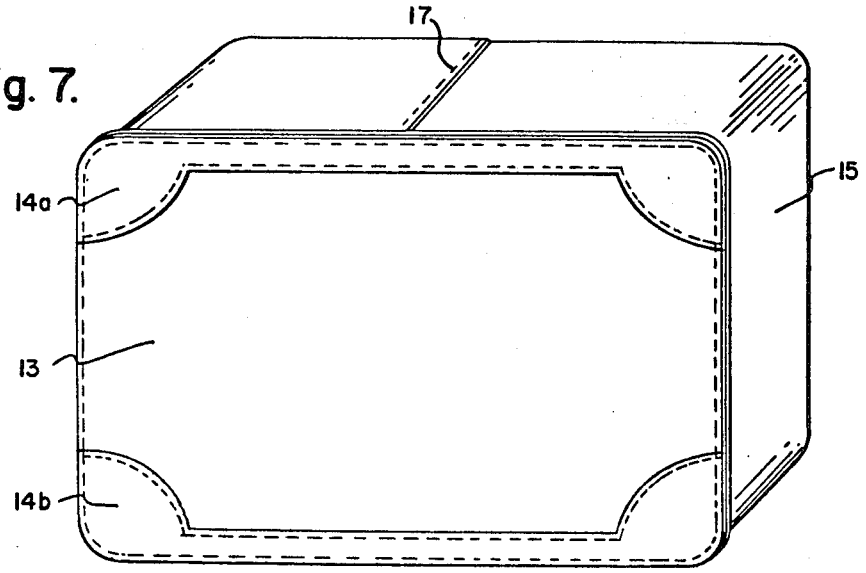

A preferred embodiment of my cover for a luggage case and its method of manufacture are more fully described hereinafter in connection with the accompanying drawings, wherein:

FIG. 1 is a perspective view showing a luggage case on which a cover made according to the method of my invention is shown in its installed position, FIGS. 2, 3, and 4 are views, showing respectively, the principal covering sheet, the decorative strips and the mounting strips comprising the novel cover, FIG. 5 is a view, illustrating the first step in making the cover, FIG. 6 is a partial sectional perspective view, through a corner edge of the luggage case, showing the relation of the parts of the cover in the assembled state, and FIG. 7 is a perspective view, showing the appearance of the cover in its finally completed form.

As will be evident from FIG. 1, the luggage case 10, as a whole, comprises two shells of substantially rectangular shape, one being shallower than the other to provide a main body portion 11 and a closure member 12. Both the body portion and the closure member are covered by preformed covers correspondingly made and installed. For convenience, only the cover for the body portion 11 of the case and its method of manufacture will be described, but it will be understood that the cover for the closure member is similar in construction and method of making.

Referring to FIGS. 2, 3 and 4 of the drawings, the parts forming the cover for the body portion 11 are shown in the form or contour to which they are cut, prior to assembly and installation. The parts are made of suitable fabric material or of flexible plastic material, such as vinyl, of a thickness of approximately 1/16 of an inch (or 2 mm). If desired, various combinations of material may be employed for different parts, such as fabric and vinyl. The vinyl sheet may have an outer surface of simulated leather finish and an interior surface consisting of a layer of smooth fabric material.

As will be seen in the drawings, the cover consists of four parts, a main cover sheet 13, (FIG. 2), two similar decorative strips 14*a* and 14*b* (FIG. 3) and a peripheral strip 15 (FIG. 4).

As will be noted from FIG. 2, the main cover sheet 13 has the four corners thereof cut away or recessed at 16. The initial step of assembly of the cover comprises placing narrow bands of glue along the top and bottom edges of the outer surface of the main cover sheet, and then in the manner shown in FIG. 5, placing the decorative strips 14*a* and 14*b* in overlying relation to the recessed corners and to the top and bottom glued areas of the main cover and pressing the strips 14*a* and 14*b* to the main cover sheet to cause them to stick together.

The next step of the assembly of the cover is the stitching of the strips to the main cover sheet along the contour of the quadrant sectors at opposite ends of the decorative strips 14*a* and 14*b* and along the straight edge connecting them. (see FIG. 6).

By reason of the recessed corners in the main cover sheet 13 and the fact that the decorative strips 14*a* and 14*b* project beyond the top and bottom edges of the main cover sheet there is only a single thickness of sheet material around the entire periphery of combined parts 13, 14*a* and 14*b* as seen in FIG. 5.

The next step in the assembly consists simply in aligning one edge of the strip 15 with the outer edge of the strip 14*a* (or 14*b*) and stitching the two together, then following on around the length of the strip 15 until it is entirely secured, by stitching to the peripheral area of the assembled parts 13, 14*a* and 14*b*. (FIG. 6).

The final step in assembling the cover consists simply in bending the strip 15 back into perpendicular relation to the main cover sheet, as shown in FIGS. 6 and 7, and stitching through the overlapping end portions thereof at 17.

The cover is readily installed in conventional manner by slipping over the body shell or closure shell, folding the excess width of the strip 15 back over the peripheral edge of the wall of the shell and sticking the cover by a suitable adhesive to the interior surface of the shell wall.

When the cover is made of vinyl sheet material, the exposed edges of the main cover sheet 13 do not require any covering. However, if the main cover sheet 13 is made of fabric material and the decorative strips 14*a* and 14*b* of vinyl material, the side edges of the fabric material are also cut off, similar to the top and bottom edges and vinyl strips are first glued and then sewn in projecting relation between the quadrant sections of the decorative strips so as to provide a single thickness of vinyl sheet entirely around the main cover sheet of fabric material.

It will be seen that I have provided a simple and relatively easy way of assemblying a cover for a luggage case, which simulates a multi-laminar decorative appearance but which is conveniently worked since actually only a single thickness of covering material is employed.

In the foregoing specification I have described presently preferred embodiments of my invention; however, it will be understood thay my invention can be otherwise embodied within the scope of the following claims.

I claim:

1. A method of making a cover for a luggage case, comprising the steps of:

(a) providing a main cover member of sheet material and substantially rectangular contour with the four corners marginally recessed, (b) providing two decorative strips of sheet material corresponding in length to the main cover member, each of said strips comprising a central portion of relatively narrow width and end areas in the shape of quadrant sectors, (c) securing said decorative strips to one face of the main cover member along opposite edges thereof so as to overlie and project beyond the opposite edges with the quadrant sectors overlying the marginal recesses at the corners of the main cover member and provide a single thickness of sheet material around the entire periphery of the main cover member, and (d) providing a flat strip of sheet material of uniform width and securing it along one edge thereof to the non-recessed areas of the main cover member and to the marginal areas of the decorative strips to form a loop for disposal at a right angle to the main cover member.

2. A method of making a cover for a luggage case according to claim 1, and further comprising the steps of:

(e) disposing the ends of said strip of sheet material of uniform width in overlapping relation, and (f) stitching through the overlapping ends of said strip of sheet material of uniform width on a line perpendicular to the main cover member.

* * * * *